US008161987B2

(12) United States Patent
Curtius et al.

(10) Patent No.: US 8,161,987 B2
(45) Date of Patent: Apr. 24, 2012

(54) DISHWASHER WITH A SYSTEM FOR RECOGNITION OF FILLING LEVEL

(75) Inventors: Georg Curtius, Dillingen (DE); Peter Schweier, Forheim (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 938 days.

(21) Appl. No.: 10/583,636

(22) PCT Filed: Dec. 13, 2004

(86) PCT No.: PCT/EP2004/053422

§ 371 (c)(1),
(2), (4) Date: Mar. 29, 2007

(87) PCT Pub. No.: WO2005/060816

PCT Pub. Date: Jul. 7, 2005

(65) Prior Publication Data

US 2007/0272286 A1 Nov. 29, 2007

(30) Foreign Application Priority Data

Dec. 22, 2003 (DE) ..... 103 60 554

(51) Int. Cl.
*A47L 15/42* (2006.01)

(52) U.S. Cl. ..... 134/113; 134/56 D; 134/57 D; 134/58 D

(58) Field of Classification Search ..... 134/113, 134/56 D, 57 D, 58 D
See application file for complete search history.

(56) References Cited

U.S. PATENT DOCUMENTS

| | | | | |
|---|---|---|---|---|
| 3,539,153 | A * | 11/1970 | Cargo et al. | 366/146 |
| 4,788,444 | A | 11/1988 | Williams | |
| 4,982,606 | A * | 1/1991 | Adamski et al. | 73/304 C |
| 6,294,906 | B1 * | 9/2001 | Kuechler | 323/371 |
| 2001/0017145 | A1 | 8/2001 | Rosenbauer et al. | |

FOREIGN PATENT DOCUMENTS

| | | |
|---|---|---|
| DE | 2 106 760 | 8/1971 |
| DE | 42 09 582 | 9/1993 |
| DE | 195 38 580 | 4/1997 |
| DE | 101 61 918 | 6/2003 |
| EP | 0 546 434 | 6/1993 |
| EP | 1 211 344 | 6/2002 |
| FR | 2 480 104 | 10/1981 |

OTHER PUBLICATIONS

International Search Report PCT/EP2004/053422.

* cited by examiner

*Primary Examiner* — Michael Barr
*Assistant Examiner* — Benjamin Osterhout
(74) *Attorney, Agent, or Firm* — James E. Howard; Andre Pallapies

(57) ABSTRACT

A dishwasher with a system for filling level recognition may be achieved which reliably determines the fluid level inside the dishwasher without the use of moving parts, whereby the dishwasher is provided with at least one capacitive filling level sensor for recognition of the fluid level of the rinsing fluid contained in the dishwasher, the electrical capacitance of which changes depending on the height of the fluid level. The fluid level in the dishwasher can thus be reliably determined without the need for moving parts and merely by the use of electronic components.

16 Claims, 2 Drawing Sheets

Figure 1:
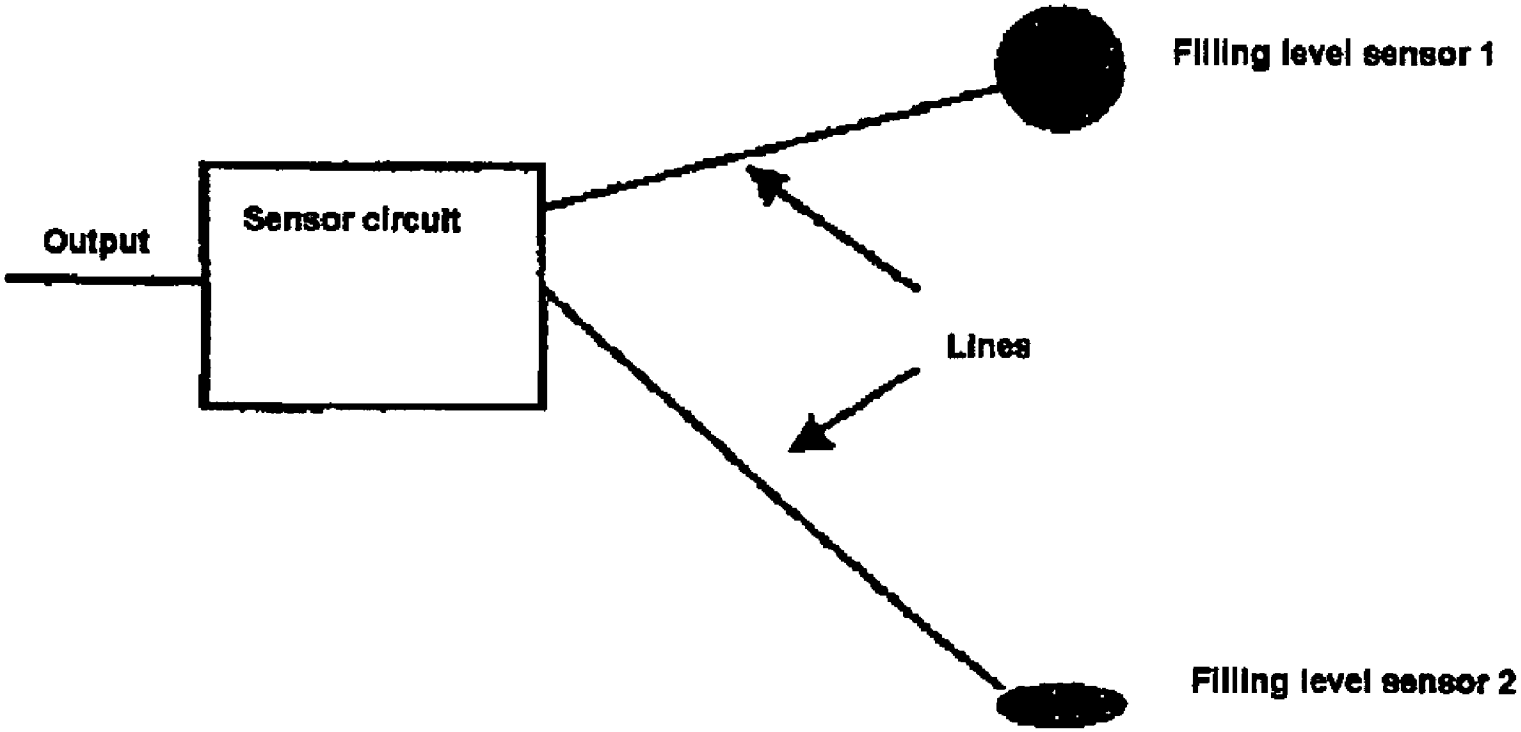

[ Fig. 001]

DISHWASHER WITH A SYSTEM FOR RECOGNITION OF FILLING LEVEL

The present invention relates to a dishwasher with a system for recognition of the fluid level of the rinsing fluid contained in the dishwasher.

Dishwashers with devices for filling level recognition are known wherein the fluid level is detected by mechanical means, for example, by floats. In devices of this type, the float floats on the liquid surface as soon as the fluid level in the dishwasher exceeds a certain level. The float is usually connected to a mechanical micro-switch which changes its switching state as a result of the floating movement of the float and passes a corresponding signal to the program controller of the dishwasher. Malfunctions frequently occur in devices of this type if, for example, as a result of the current loading of the micro-switch contacts being too low, their switching reliability is not ensured, which results in inadequate switching behaviour. Furthermore, floats can be raised by air bubbles ascending in the rinsing fluid and thus the micro-switch can be actuated without the desired fluid level actually being present.

Other systems for detecting the fluid level in a dishwasher use a pressure capsule which is compressed as the fluid level rises. The fluid level in the dishwasher can be determined from the extent of the compression of the pressure capsule. The known systems for filling level recognition all have the disadvantage that they have a number of mechanically moveable parts which are liable to wear and contamination, for example, by deposited dishwashing residue which can result in tolerance problems to the extent of complete failure of the device for filling level recognition.

It is the object of the present invention to provide a dishwasher with a system for filling level recognition which reliably determines the fluid level in the dishwasher without using moving parts whilst keeping production costs low.

The dishwasher according to the invention comprises at least one washing container for receiving items to be washed and a system for recognition of the fluid level of the rinsing fluid contained in the dishwasher, wherein at least one capacitive filling level sensor is provided whose electrical capacitance changes on contact with the rinsing fluid.

An advantage of the dishwasher according to the invention is that in the system for recognition of the filling level according to the invention the mechanical micro-switches usually used previously are replaced by a purely electronic sensor system, thus eliminating problems arising from too-low switching currents and the switching uncertainties caused thereby. A malfunction caused by vibration or frothy rinsing fluid cannot occur in the capacitive detection of fluid level according to the present invention. The system according to the invention is consequently more stable and yields results having higher reproducibility than the known systems for filling level recognition.

A further advantage of the dishwasher according to the invention can be seen in that moving components required previously are eliminated whereby both the assembly effort and therefore the productions costs can be reduced and the failure rate is lowered because of the reduction in components. Since the fluid level in the dishwasher is determined without moving parts and merely by using electronic components, the system for recognition of fluid level according to the invention is largely not liable to wear and contamination by deposited food residues. Since space no longer needs to be taken into account for mechanical devices, another advantage of the system for recognition of fluid level according to the invention is that it only requires a very small amount of space and thus can be accommodated almost arbitrarily, even in inaccessible locations in the dishwasher.

The rinsing fluid used in dishwashers corresponds to a solution mixed with cleaning agents, which substantially consists of water. Water has a relative dielectric constant of $\in_w=81$ which differs significantly from the dielectric constant of air ($\in_L=1$). This significant difference between the dielectric constants of water and air is used as the physical basis in the system for filling level recognition according to the present invention to determine the fluid level in the dishwasher. For this purpose, the filling level sensor is constructed in the fashion of a capacitor whose electrical capacitance varies depending on the height of the filling level. The variation in the electrical capacitance of the capacitive filling level sensor is based on the physical law that in addition to the capacitor area and its spacing, the electrical capacitance of a capacitor depends on the dielectric constant of the medium or the dielectric that is located in the electromagnetic field formed between the capacitor surfaces. These relationships can be represented by the following equation where C is the electrical capacitance of the capacitor, A is the capacitor area, d is the distance between the capacitor surfaces and $\in$ is the dielectric constant of the dielectric:

$$C=\in A/d.$$

If the dielectric or the medium which is located in the electromagnetic field between the capacitor surfaces, changes, the factor of the dielectric constant $\in$ also varies. Since the other factors in the aforesaid equation remain unchanged, the capacitance of the capacitive filling level sensor varies in direct proportion to the variation in the dielectric constant of the dielectric. In a preferred embodiment of the present invention, the electrical capacitance of the filling level sensor varies depending on the dielectric constant of the medium surrounding the filling level sensor.

In the device according to the invention for recognition of filling level, a filling level sensor is used which represents only one capacitor surface whilst the other capacitor surface is formed by the surroundings of the filling level sensor. This means in the specific application according to the present invention that the electrical capacitance of the capacitive filling level sensor is approximately increased by a factor of 81 when the filling level sensor is surrounded by water instead of air. This change in capacitance can appropriately be detected and evaluated using an electronic circuit connected to the capacitive filling level sensor.

According to a further preferred embodiment of the present invention, at least two filling level sensors are provided between which an electric circuit is closed as soon as the filling level sensors simultaneously come in contact with the rinsing fluid. In this case, it is sufficient if this electric circuit only utilised low current. In this embodiment the different electrical conductivity of water and air is used as a reliable distinguishing feature to determine whether the filling level sensors are surrounded by air or by water, i.e. whether the level of the rinsing fluid in the dishwasher has reached a certain height or not.

It is especially advantageous if the system for filling level recognition additionally has electronic means which detect the electrical capacitance or the electrical conductivity of the filling level sensor and its variation preferably qualitatively and quantitatively. By quantitatively detecting the variation in the electrical capacitance or the electrical conductivity of the filling level sensor, it is not only determined whether a certain fluid level is reached, exceeded or fallen below but preferably also the exact height of the fluid level. Such an electric circuit can be implemented in a particularly practical manner in the form of one or more integrated circuits which are favourable to manufacture and require little space. In addition, one or more integrated circuits can be provided which are capable of evaluating the signals from a plurality of active sensor surfaces.

The area of the filling level sensor which comes in contact with the rinsing liquid can have any shape. However, a qualitative determination of the liquid level by means of a single filling level sensor is favoured if the area of the filling level sensor which comes in contact with the rinsing liquid has an extended, substantially rectangular shape. If a filling level sensor having a rectangular contact area is disposed vertically in the washing container of the dishwasher, as the liquid level rises an increasingly larger area of the filling level sensor is covered with rinsing liquid. As a result of the increasing contact area between the filling level sensor and the rinsing liquid, the electrical capacitance of the filling level sensor varies successively. This variation can be detected and evaluated by the electronic means connected to the filling level sensor in order to determine the exact fluid level therefrom.

The capacitive filling level sensor is appropriately disposed in the dishwasher such that a specific fluid level in the dishwasher can be determined by the filling level sensor or it can be determined if this fluid level is exceeded or fallen below. It is also possible to allocate gradations of the change in capacitance of the filling level sensor to specific fluid levels of the washing liquid in the dishwasher so that it is possible to determine not only whether certain fluid levels have been exceeded or fallen below, but also the exact height of the fluid level in the washing container of the dishwasher can be determined using the capacitive filling level sensor according to the invention.

In addition, according to a further preferred embodiment of the present invention, one or more filling level sensors are arranged at a specific height in the washing container. Thus, for example, a filling level in the washing container of the dishwasher which is too high or too low can be recognised by arranging a filling level sensor in the washing container at the height of a maximum and/or a minimum fluid level. During operation of a dishwasher, in particular two specific fluid levels are generally of particular importance. These are firstly the so-called filling level corresponding to the desired or optimal fluid level for a washing process and secondly, the so-called safety level which marks the maximum fluid level at which the dishwasher can still operate without any problems. In a further preferred embodiment of the present invention, the system for recognition of filling level therefore comprises a plurality of filling level sensors which are disposed at the height of specific fluid levels, such as the filling level and the safety level.

If the levels between the optimal filling level and the safety level are close together, it is also possible to determine or monitor both levels using one filling level sensor. For this purpose, a filling level sensor is arranged in each case at the height of the specific levels for optimally filling and the safety level in the washing container. As a result of the gradual change in the electrical capacitance of the filling level sensor as the fluid level rises or falls and if corresponding reference values are provided in the electronic memory means, the instantaneous fluid level of the rinsing fluid in the washing container can be determined by comparing the capacitance of the filling level sensor which is actually determined, with the stored reference values. In this way, a plurality of fluid levels can be monitored or controlled using only one filling level sensor.

The presence of rinsing fluid and its fluid level at different points in the dishwasher can also be determined by using a plurality of filling level sensors. For example, one filling level sensor can be arranged in the bottom tray of the dishwasher to determine the rinsing fluid which has run out from the washing container into the base assembly.

Since the capacitive filling level sensors only require an extremely small amount of space, their shape can be adapted to almost any fixing situation and since the material condition of the sensor surfaces embodied as thin metal films is very flexible, the filling level sensors can be arranged at almost any positions on the washing container of the dishwasher. Thus, a position which is extremely inaccessible for a mechanical solution or which has extremely restricted space requirements can be selected. Furthermore, the shape of the active sensor surfaces themselves can be adapted to the space requirements at the relevant location in the dishwasher.

In order that the fluid level in the dishwasher can be determined as accurately as possible, the filling level sensor is located inside the washing container preferably at a location protected from spray water. This can avoid the determination of the fluid level in the dishwasher being falsified by spray water which can come in contact with the filling level sensor during washing. For easy mounting of the filling level sensor it is particularly advantageous if a fixing strip of the filling level sensor is provided with a self-adhesive layer. In this way, the filling level sensor can easily be positioned on the wall of the washing container, for example, without needing to damage this for screw fixings or similar.

The present invention is explained in detail hereinafter using a preferred embodiment with reference to the appended drawings.

FIG. 1 is a schematic diagram of a system for recognition of filling level according the present invention in a first preferred embodiment. The system for recognition of filling level shown comprises a filling level sensor 1 which is located at a specific height in the washing container of the dishwasher. As soon as the rinsing fluid has reached this specific height, it comes in contact with the filling level sensor 1 whereupon the filling level sensor 1 changes its electrical capacitance. In addition, a second filling level sensor 2 is provided, which is disposed for example in the base assembly of the dishwasher. The second filling level sensor 2 can be used to determine whether rinsing fluid has flowed from the washing container into the base assembly, since the filling level sensor 2 changes its capacitance when it comes in contact with rinsing liquid.

Figure 2:
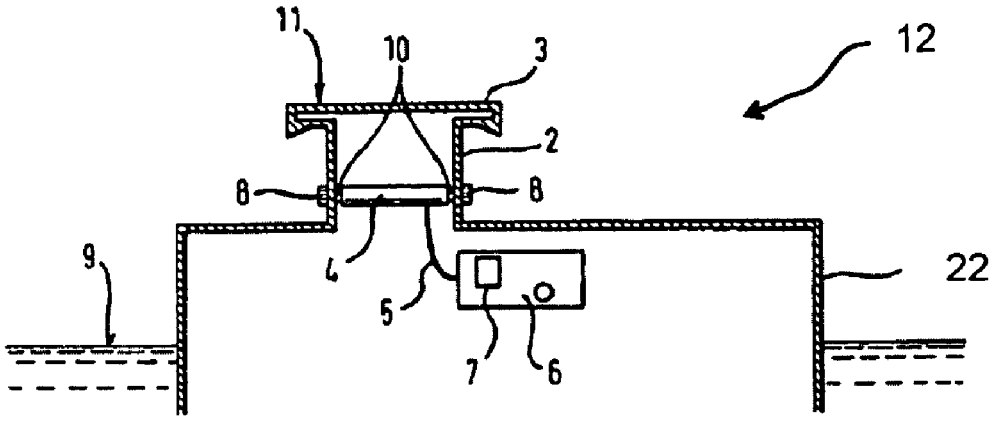

FIG. 2 shows a cross section through a part of the sump of a dishwasher having a system for filing level recognition according to the present invention. Since the sump forms the lower part of the washing container in which the washing fluid contained in the dishwasher collects, the sump is a particularly suitable location out of the system for filling level recognition in the dishwasher. FIG. 1 only shows part of the sump which is embodied in the form of an upper elevation 12. In the drawing, elevation 12 in the sump is surrounded by washing fluid, the fluid level 9 being in the lower area of the sump of the dishwasher.

A dome 11 is formed in the upper area of the elevation 12 where the walls 22 of the sump, the elevation 12 and the dome 11 are each integrally connected and thus form the wall 22 of the washing container in its lower range. As a result, the interiors of the sump, the elevation 12 and the dome 11 are interconnected and protected from washing fluid which flushes around the dome 11 and the elevation 12. A filling level sensor 4 is located in the interior of the dome 11. The filling level sensor 4 is constructed in the form of a straight rod having an active sensor surface 10 at its opposite ends. During operation of the system for filling level recognition, a certain charge carrier distribution is established at the active sensor surfaces 10 which varies depending on the level 9 of the washing fluid in the dishwasher. The active sensor surfaces 10 of the filling level sensor 4 each adjoin the inside of the wall 22 so that the active sensor surfaces 10 of the filling level sensor 4 are always separated from the washing fluid by the wall 22. In this manner, the filling level sensor 4 is protected from disturbing effects of the washing fluid and dishwashing residues or detergents contained therein. Respectively, one sensor probe 8 is arranged on the inside wall 22 opposite the active sensor surfaces 10.

The sensor probes 8 consist of an electrically conducting material so that an electromagnetic field can be formed between the sensor probes 8 and the filling level sensor 4. This electromagnetic field varies depending on the dielectric constant of the medium surrounding the sensor probes 8 and therefore depending on the fluid level 9 of the washing fluid and the dishwasher. As soon as the fluid level 9 of the washing fluid in the dishwasher rises or the washing fluid contacts the sensor probes 8 electrical charge distribution on the filling level sensor 4 or its electrical capacities it varies.

The filling level sensor 4 is connected to an electronic circuit 6 by an electronic lead 5 which detects and evaluates the variation of the charge distribution in the filling level sensor 4 or the variation of its electrical capacitance. The electronic circuit includes one or more integrated circuits 7 which are specifically programmed to evaluate the signals delivered by the filling level sensor 4. The results of this evaluation is passed to the program control of the dishwasher for use in controlling dishwasher operation.

The dome 11 is constructed on its upper side in the form of a hanging roof 3 which services to protect the sensor probes 8 from spray water. The spray water protection 3 is used to avoid incorrect measurements of the system for filling level recognition which could be caused by washing fluid spraying on to the sensor probes 8 during washing operation. Therefore, only the actual fluid level 9 of the washing fluid in the dishwasher is determined by the system for filling level recognition.

The filling level sensors 1 and 2 consist of electrically conducting material and are each connected by an electrical lead to a sensor circuit which detects and evaluates the change in the electrical capacitance of the filling level sensors. The sensor circuit comprises one or more integrated circuits specially programmed to evaluate the signals delivered by the filling level sensors. The result of this evaluation is passed from the sensor circuit via an output lead to the program controller of the dishwasher which, if necessary, initiates measures to change the level of the rinsing fluid in the dishwasher, such as opening a valve for the fresh water supply, actuating the lye pump to pump out rinsing fluid from the dishwasher or activating a warning that rinsing fluid has flowed out of the washing container into the base assembly of the dishwasher.

In a second embodiment of the present invention both filling level sensors 1 and 2 are located in the washing container of the dishwasher and exposed to a low current so that a low current circuit is closed between them as soon as both filling level sensors simultaneously come in contact with rinsing fluid. In this way, it can be determined whether the level of rinsing fluid in the dishwasher has reached the height of the upper filling level sensor 1 or has fallen below this level again.

The invention claimed is:

1. A dishwasher comprising:

at least one washing container for receiving items to be handled, with the items to be handled being subjected to an operative handling cycle including at least one of a washing step, a rinsing step and a drying step wherein the washing step includes introduction of a cleaning agent and a fluid carrier forming a washing fluid and the rinsing step includes introduction of a rinsing fluid; and a system for recognition of the fluid level of the rinsing fluid contained in the dishwasher, the fluid level recognition system having at least one capacitive filling level sensor having at least two probes, forming two capacitor plates, each operatively coupled to a sensor surface and projecting into the washing container for operative contact with the rinsing fluid, thereby using the rinsing fluid as a dielectric having a dielectric constant that changes with the fill level of the rinsing fluid, wherein at a first fill level the probes and the rinsing fluid form a capacitor having a first capacitance value indicating a first fill level and causing the filling level sensor to sense the first fill level and at a second fill level the probes and the rinsing fluid form a capacitor having a second capacitance value indicating a second fill level and causing the filling level sensor to sense the second fill level, wherein at least two filling level sensors are provided between which an electrical circuit closes at low current as soon as the filling level sensors simultaneously come in contact with the rinsing fluid.

2. The dishwasher according to claim 1, wherein at least one filling level sensor is in the form of a capacitor whose electrical capacitance varies depending on the dielectric constant of the medium surrounding the filling level sensor.

3. The dishwasher according to claim 1, wherein the system for recognition of filling level comprises electronic means which qualitatively and quantitatively detect the electrical capacitance or the electrical conductivity of the filling level sensor and its variation.

4. The dishwasher according to claim 1, wherein at least one filling level sensor is arranged in a base assembly in such a manner that rinsing fluid that has flowed from the washing container into the base assembly can be detected.

5. The dishwasher according to claim 1, wherein the system for recognition of filling level comprises a filling level sensor by which means at least two different fluid levels can be determined.

6. The dishwasher according to claim 1, wherein at least one filling level sensor has an extended, preferably-substantially rectangular shape.

7. The dishwasher according to claim 1, wherein at least one filling level sensor is located inside the washing container at a position protected from spray water.

8. The dishwasher according to claim 1, wherein a fixing side of at least one filling level sensor is provided with a self-adhesive layer.

9. A dishwasher comprising:

at least one washing container for receiving items to be handled, with the items to be handled being subjected to an operative handling cycle including at least one of a washing step, a rinsing step and a drying step wherein the washing step includes introduction of a cleaning agent and a fluid carrier forming a washing fluid and the rinsing step includes introduction of a rinsing fluid; and a system for recognition of the fluid level of the rinsing fluid contained in the dishwasher, the fluid level recognition system having at least one capacitive filling level sensor having at least two probes, forming two capacitor plate, each operatively coupled to a sensor surface and projecting into the washing container for operative contact with the rinsing fluid, thereby using the rinsing fluid as a dielectric having a dielectric constant that changes with the fill level of the rinsing fluid, wherein at a first fill level the probes and the rinsing fluid form a capacitor having a first capacitance value indicating a first fill level and causing the filling level sensor to sense the first fill level and at a second fill level the probes and the rinsing fluid form a capacitor having a second capacitance value indicating a second fill level and causing the filling level sensor to sense the second fill level, wherein the system for recognition of filling level comprises a number of capacitive filling level sensors which are arranged at the height of specific fluid levels on the washing container.

10. The dishwasher according to claim 9, wherein at least one filling level sensor is in the form of a capacitor whose electrical capacitance varies depending on the dielectric constant of the medium surrounding the filling level sensor.

11. The dishwasher according to claim 9, wherein the system for recognition of filling level comprises electronic means which qualitatively and quantitatively detect the electrical capacitance or the electrical conductivity of the filling level sensor and its variation.

12. The dishwasher according to claim 9, wherein at least one filling level sensor is arranged in a base assembly in such a manner that rinsing fluid that has flowed from the washing container into the base assembly can be detected.

13. The dishwasher according to claim 9, wherein the system for recognition of filling level comprises a filling level sensor by which means at least two different fluid levels can be determined.

14. The dishwasher according to claim 9, wherein at least one filling level sensor has an extended, substantially rectangular shape.

15. The dishwasher according to claim 9, wherein at least one filling level sensor is located inside the washing container at a position protected from spray water.

16. The dishwasher according to claim 9, wherein a fixing side of at least one filling level sensor is provided with a self-adhesive layer.

* * * * *